US007050542B2

(12) United States Patent
Bathe et al.

(10) Patent No.: US 7,050,542 B2
(45) Date of Patent: May 23, 2006

(54) DEVICE FOR GENERATING X-RAYS HAVING A HEAT ABSORBING MEMBER

(75) Inventors: Christoph Helmut Bathe, Hamburg (DE); Wolfgang Chrost, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/510,004

(22) PCT Filed: Mar. 10, 2003

(86) PCT No.: PCT/IB03/00903

§ 371 (c)(1),
(2), (4) Date: Sep. 30, 2004

(87) PCT Pub. No.: WO03/083891

PCT Pub. Date: Oct. 9, 2003

(65) Prior Publication Data

US 2005/0201519 A1 Sep. 15, 2005

(30) Foreign Application Priority Data

Apr. 2, 2002 (EP) ..... 02076302

(51) Int. Cl.
*H01J 35/16* (2006.01)

(52) U.S. Cl. ..... 378/142; 378/141; 378/128

(58) Field of Classification Search ..... 378/127, 378/128, 129, 130, 141, 142, 121
See application file for complete search history.

(56) References Cited

U.S. PATENT DOCUMENTS 5,056,126 A * 10/1991 Klostermann et al. ..... 378/127
5,995,585 A 11/1999 Salasoo
6,215,852 B1 * 4/2001 Rogers et al. ..... 378/142

FOREIGN PATENT DOCUMENTS

WO WO 99/08305 2/1999

* cited by examiner

*Primary Examiner*—Edward J. Glick
*Assistant Examiner*—Anastasia Midkiff
(74) *Attorney, Agent, or Firm*—Douglas B. McKnight

(57) ABSTRACT

The invention relates to a device for generating X-rays (41). The device comprises a source (5) for generating an electron beam (35), and a carrier (7) which is rotatable about an axis of rotation (15) and which is provided with a material (9) which generates the X-rays as a result of the incidence of the electron beam thereon. The device further comprises a heat absorbing member (45) which is arranged between the source and the carrier to catch electrons, which are scattered back from an impingement position (39) of the electron beam on the carrier, and to absorb a portion of the radiant heat generated by the carrier when heated during operation. The heat absorbing member is in thermal connection with a cooling system (51) of the device. According to the invention, the thermal connection between the heat absorbing member (45) and the cooling system (51) comprises a thermal barrier (57) which limits a rate of heat transfer (( ) occurring via the thermal connection per unit of temperature difference between the heat absorbing member and the cooling system. In a particular embodiment, said thermal barrier comprises an annular mounting member (57) having a limited dimension (hB), by means of which the heat absorbing member is mounted in the device. As a result of said thermal barrier, the heat absorbed by the heat absorbing member is gradually transferred to the cooling system, so that thermal peak loads on the cooling system and problems like boiling of the cooling liquid are avoided. In addition, relatively high temperatures of the heat absorbing member are allowed, so that the mass and volume of the heat absorbing member, which are necessary to provide the heat absorbing member with a sufficiently large heat absorbing capacity, are considerably reduced.

16 Claims, 3 Drawing Sheets

DEVICE FOR GENERATING X-RAYS HAVING A HEAT ABSORBING MEMBER

Figure 1:
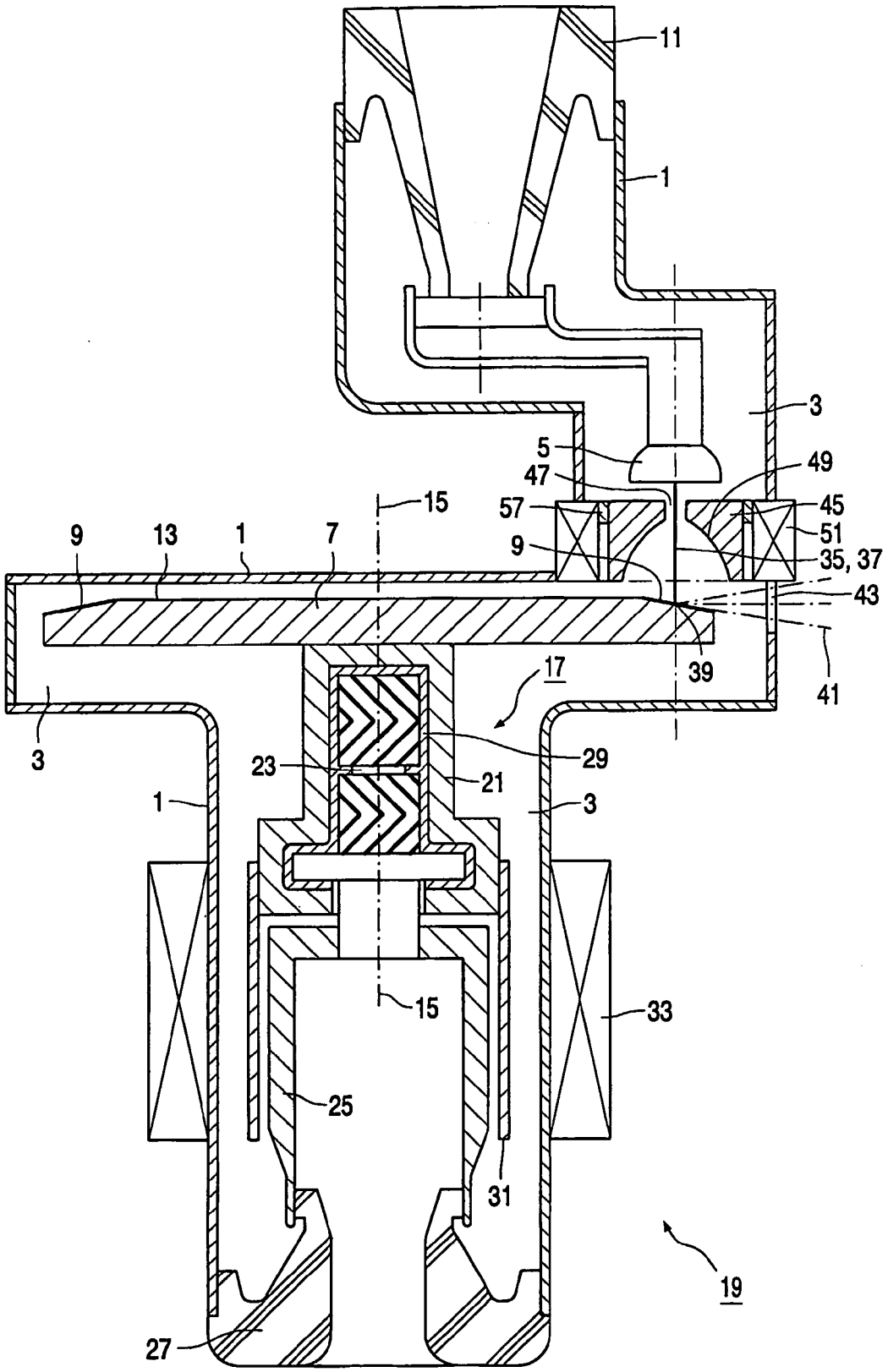

The invention relates to a device for generating X-rays, which device comprises a source for emitting electrons, a carrier which is rotatable about an axis of rotation and which is provided with a material which generates X-rays as a result of the incidence of electrons, a heat absorbing member arranged between the source and the carrier, and a cooling system which is in thermal connection with the heat absorbing member, wherein during operation a rate of heat absorption by the heat absorbing member is substantially larger than a rate of heat transfer via the thermal connection.

A device of the kind mentioned in the opening paragraph is known from U.S. Pat. No. 6,215,852. The source, the carrier, and the heat absorbing member are accommodated in a vacuum space of the device. The carrier is disc-shaped and is rotatably journalled by means of a bearing. During operation, an electron beam generated by the source passes through a central cavity provided in the heat absorbing member and impinges upon the X-ray generating material of the carrier in an impingement position near the circumference of the carrier. As a result, X-rays are generated in said impingement position, which emanate through an X-ray exit window provided in a housing enclosing the vacuum space. The heat absorbing member has the same electrical potential as the carrier and is arranged between the source and the carrier to catch electrons, which are scattered back from the carrier, and to absorb radiant heat generated by the carrier when heated during operation, as a result of which the heat absorbing member is heated during operation. The cooling system comprises a channel for a cooling liquid, which is provided in a circumferential portion of the heat absorbing member in direct thermal contact with the heat absorbing member. As a result, the thermal connection between the heat absorbing member and the cooling system has a relatively high thermal conductivity. The heat absorbing member is made from copper and has a relatively large mass and volume, so that the heat absorbing member has a large heat absorbing capacity. Thus, when the device is temporarily in operation to generate X-rays of a relatively high energy level, a relatively large rate of heat absorption by the heat absorbing member temporarily occurs, during which the heat absorbing member undergoes a moderate temperature increase only. As a result of said moderate temperature increase, the rate of heat transfer from the heat absorbing member to the cooling system is limited, and the heat absorbed by the heat absorbing member is gradually transferred to the cooling system during the time that the device generates X-rays and afterwards when the device is not in operation. As a result of said gradual transfer of the heat from the heat absorbing member to the cooling system, thermal peak loads on the cooling system are prevented, so that cooling system problems, such as boiling of the cooling liquid or melting of thin-walled structures of the cooling system, are prevented.

A disadvantage of the known device is that the device has relatively large dimensions and a relatively large weight as a result of the relatively large mass and volume of the heat absorbing member.

It is an object of the invention to provide a device for generating X-rays of the kind mentioned in the opening paragraph, which also has the advantage of a gradual transfer of heat from the heat absorbing member to the cooling system, but in which the mass and volume of the heat absorbing member are significantly reduced.

To achieve this object, a device for generating X-rays according to the invention is characterized in that the thermal connection between the heat absorbing member and the cooling system comprises a thermal barrier which limits the rate of heat transfer, occurring via the thermal connection per unit of temperature difference between the heat absorbing member and the cooling system, in a predetermined manner. In the device according to the invention, a gradual transfer of heat from the heat absorbing member to the cooling system is not achieved by moderating the maximal temperature reached by the heat absorbing member during the generation of X-rays, as in the device known from U.S. Pat. No. 6,215,852, but by limiting the rate of heat transfer which occurs via the thermal connection per unit of temperature difference between the heat absorbing member and the cooling system, i.e. by limiting the thermal conductivity of the thermal connection. As a result, a relatively high maximal temperature of the heat absorbing member is allowed during the generation of X-rays, provided that the heat absorbing member is made from a suitable material having a sufficiently high melting temperature. As a result of the relatively high maximal temperature allowed, only a relatively small mass and volume of the heat absorbing member are required to enable the heat absorbing member to absorb a total amount of heat comparable to the amount of heat absorbed by the heat absorbing member of the known device. Since the necessary thermal conductivity of the thermal connection is limited, less high demands have to be made also upon the thermal conductivity of the material of the heat absorbing member, so that a range of suitable materials for the heat absorbing member is not limited by demands imposed on the thermal conductivity of the material.

A particular embodiment of a device according to the invention is characterized in that a cross-sectional heat transfer coefficient $\theta=\phi/P_{max}$ of the thermal connection is smaller than 0,0005 $K^{-1}$, wherein (in kW/K) is the rate of cross-sectional heat transfer via the thermal connection per unit of difference between an average temperature of the heat absorbing member and a temperature at a thermal boundary between the thermal connection and the cooling system, and wherein $P_{max}$ (in kW) is a maximal output power of the source allowed during continuous operation of the device. If said cross-sectional heat transfer ratio $\theta$ is smaller than 0.0005 $K^{-1}$, a relatively high maximal temperature of the heat absorbing member is achieved during operation, so that the mass and volume of the heat absorbing member, which are necessary to enable the heat absorbing member to absorb a sufficiently large amount of heat, are considerably reduced.

A particular embodiment of a device according to the invention is characterized in that the thermal barrier comprises a mounting member by means of which the heat absorbing member is mounted in the device, said mounting member having a dimension, seen in a direction parallel to an electron beam path of the source, which is substantially smaller than a dimension of the heat absorbing member in said direction. In this embodiment the mounting member, which is necessary to mount the heat absorbing member in the device, also constitutes the necessary thermal barrier or a part thereof, as a result of which the device has a simple construction with a limited number of parts. Since said dimension of the mounting member is relatively small, the mounting member has a relatively small cross-sectional area, as a result of which the rate of heat transfer, occurring via the thermal barrier per unit of temperature difference between the heat absorbing member and the cooling system, is effectively reduced. A predetermined limitation of said rate of heat transfer can be achieved by a suitable value of said cross-sectional area, i.e. by a suitable value of said dimension of the mounting member.

A further embodiment of a device according to the invention is characterized in that the heat absorbing member is substantially rotationally symmetrical relative to the electron beam path, and the mounting member is annular and concentric relative to the electron beam path. In this further embodiment, the heat absorbing member is evenly warmed up by the electrons scattered back from the carrier, and the heat absorbed by the heat absorbing member is evenly transferred, seen in a circumferential direction of the annular mounting member, via the mounting member to the cooling system. In this manner, the risk of excessive local temperatures of the heat absorbing member, the mounting member, and the cooling system is considerably reduced.

A further embodiment of a device according to the invention is characterized in that the mounting member is made from a material having a thermal conductivity which is lower than a thermal conductivity of a material from which the heat absorbing member is made. Since the thermal conductivity of the material of the mounting member is lower than the thermal conductivity of the material of the heat absorbing member, the rate of heat transfer, occurring via the mounting member per unit of temperature difference between the heat absorbing member and the cooling system, is effectively reduced.

A further embodiment of a device according to the invention is characterized in that the mounting member is made from stainless steel. Stainless steel is a very suitable material for the mounting member in view of its heat conducting properties, its thermal expansion properties, and its mechanical properties.

A further embodiment of a device according to the invention is characterized in that the heat absorbing member has a first side facing the carrier and a second side facing away from the carrier, the mounting member being in thermal contact with the heat absorbing member near said second side. Near the second side, during operation, the heat absorbing member has a temperature which is lower than an average temperature of the heat absorbing member and lower than a temperature near the first side. As a result, the rate of heat transfer from the heat absorbing member to the cooling system via the mounting member is further reduced, so that the transfer of heat from the heat absorbing member to the cooling system takes place even more gradually.

A particular embodiment of a device according to the invention is characterized in that the thermal barrier comprises a vacuum gap which is present between a radiant heat transferring surface of the heat absorbing member and a radiant heat transferring surface of the cooling system. In this embodiment, the heat absorbing member is mounted in the device by means of, for example, a mounting member which is preferably made from a thermally insulating material. Thus the transfer of heat from the heat absorbing member to the cooling system mainly takes place by heat radiation via said vacuum gap, as a result of which the rate of heat transfer, occurring via the thermal barrier per unit of temperature difference between the heat absorbing member and the cooling system, is effectively reduced. A predetermined limitation of said rate of heat transfer can be achieved by suitable values of the areas of said radiant heat transferring surfaces of the heat absorbing member and of the cooling system and by a suitable value of the width of the gap.

A particular embodiment of a device according to the invention is characterized in that the heat absorbing member is made from molybdenum, tungsten, or graphite. Said materials have relatively high melting temperatures, so that relatively high temperatures of the heat absorbing member are allowed, and so that the mass and volume of the heat absorbing member, which are necessary for a sufficient rate of heat absorption by the heat absorbing member, are considerably reduced.

A particular embodiment of a device according to the invention is characterized in that a side of the heat absorbing member facing the carrier has an electron absorbing surface which is concave as seen from an impingement position of the electrons on the carrier. The electrons scattered back from the impingement position have an energy level which depends on an angle $\alpha$ at which the electrons are scattered back relative to the path of the electron beam generated by the source. Said energy level is approximately proportional to $\sin(2\alpha)$, so that said energy level increases from approximately 0 at $\alpha=0°$ to a maximal value approximately at $\alpha=45°$. As a result of the fact that the electron absorbing surface of the heat absorbing member is concave, the portion of the electron absorbing surface available to catch the electrons scattered back at a certain angle $\alpha$ also increases between $\alpha=0°$ and $\alpha=45°$. As a result, a substantially uniform rate of heat absorption per unit of area of the electron absorbing surface is achieved, so that the heat absorbing member is substantially uniformly heated up by the scattered electrons and excessive local temperatures of the heat absorbing member are avoided.

Figure 2:
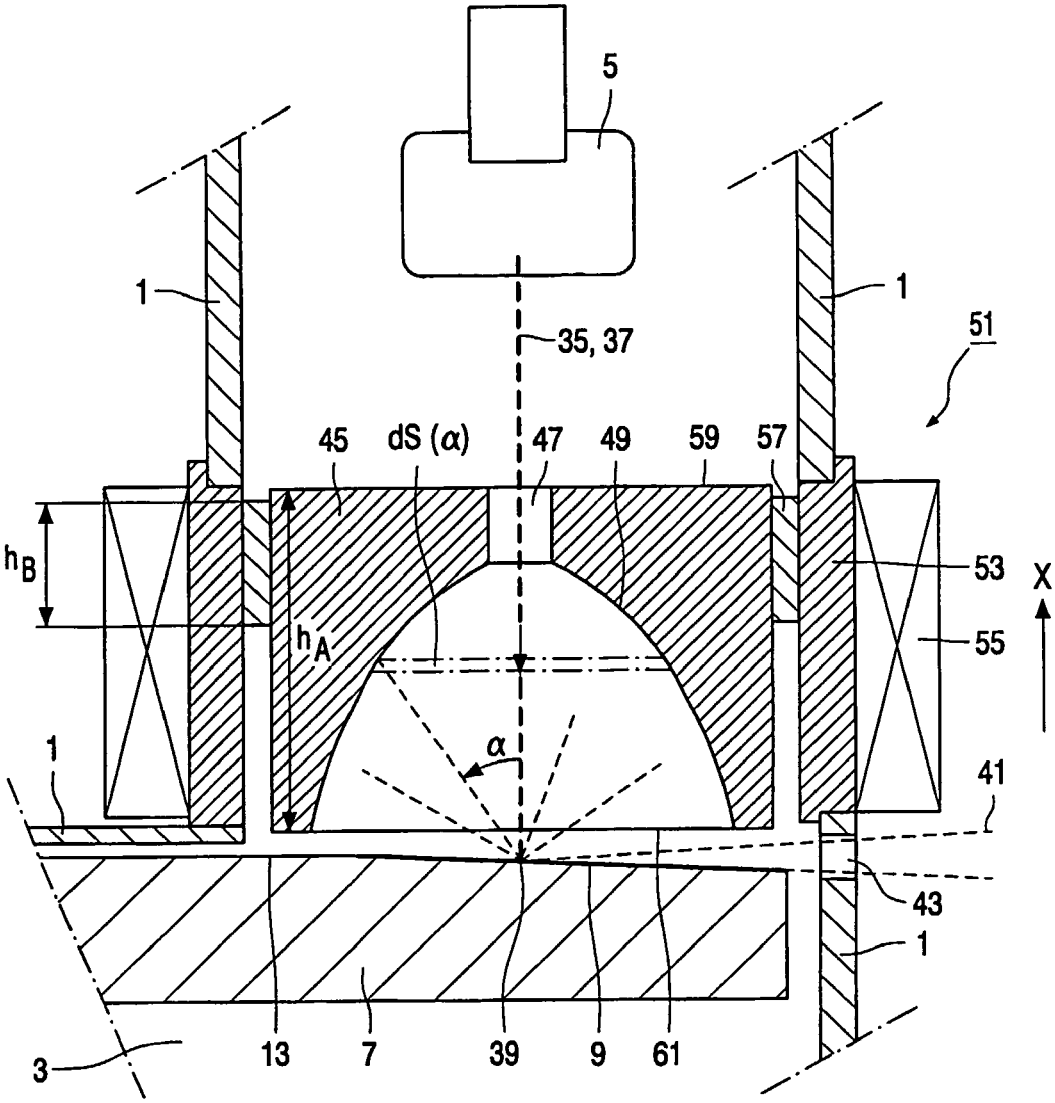
Figure 3:
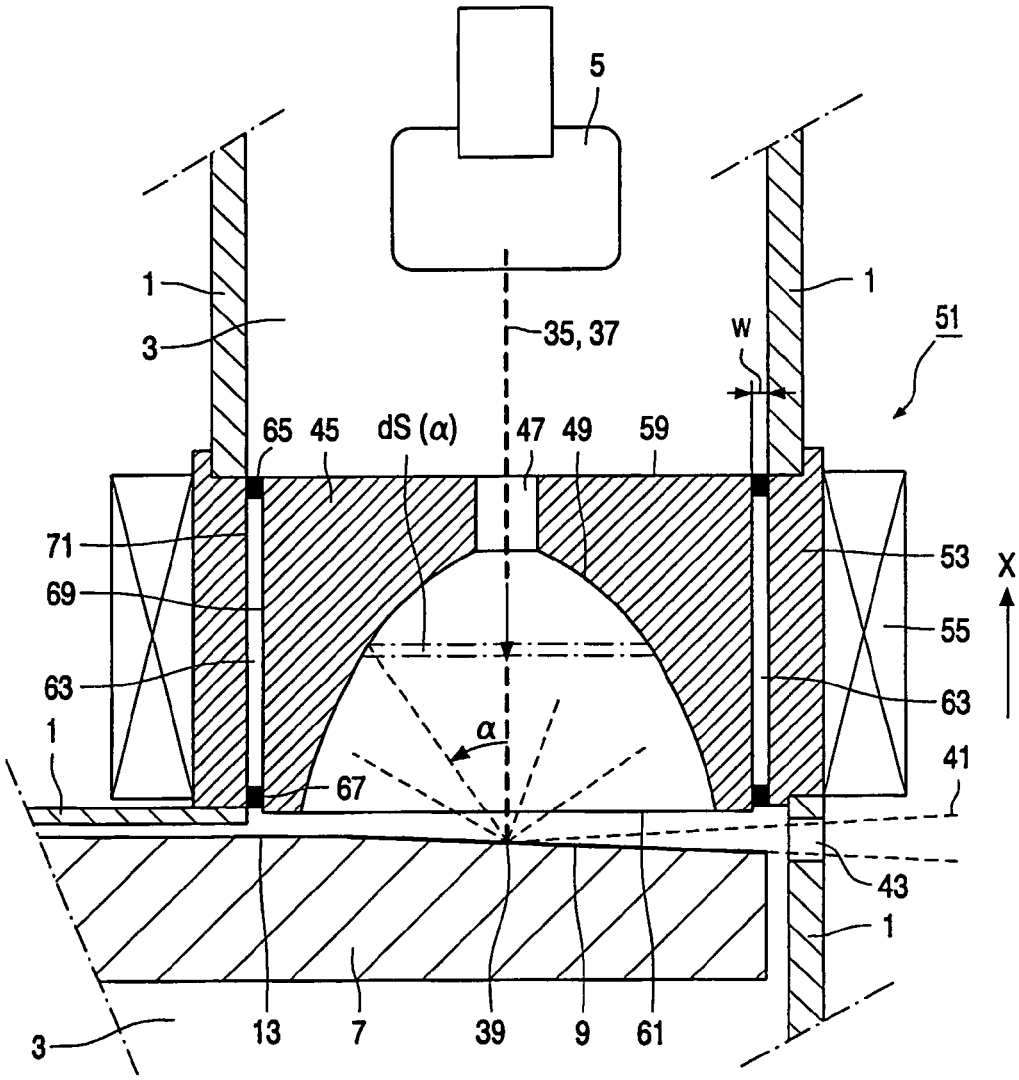

In the following, embodiments of a device for generating X-rays according to the invention will be described in detail with reference to the Figures, in which FIG. 1 schematically shows a longitudinal section of a first embodiment of a device for generating X-rays according to the invention, FIG. 2 schematically shows a heat absorbing member of the first embodiment of FIG. 1, and FIG. 3 schematically shows a heat absorbing member of a second embodiment of a device for generating X-rays according to the invention.

The first embodiment of a device for generating X-rays according to the invention as shown in FIG. 1 comprises a metal housing 1 enclosing a vacuum space 3, in which a source 5 or cathode for emitting electrons and a carrier 7 or anode provided with a material 9 which generates X-rays as a result of the incidence of electrons are present. The source 5, which is only schematically shown in FIG. 1, is mounted to the housing 1 by means of a first mounting member 11 made from an electrically insulating material. The carrier 7 is substantially disc-shaped, and the X-ray generating material 9, in this embodiment tungsten, is provided in the form of an annular layer on a main side 13 of the carrier 7 facing the source 5. The carrier 7 is made from a material having a relatively high melting temperature, in this embodiment molybdenum. Alternatively, the carrier 7 in its entirety may be made from the X-ray generating material.

The carrier 7 is rotatable about an axis of rotation 15 which extends perpendicularly to the main side 13. For this purpose, the device comprises a dynamic groove bearing 17, by means of which the carrier 7 is journalled, and an electric motor 19, by means of which the carrier 7 can be driven. The dynamic groove bearing 17 comprises an external bearing member 21, which is mounted to the carrier 7, and an internal bearing member 23, which is mounted to the housing 1 by means of a supporting member 25 and a second mounting member 27. Between the external bearing member 21 and the internal bearing member 23, a bearing gap 29 is present which is filled with a liquid lubricant, in this embodiment an alloy of gallium, indium, and tin. The motor 19, which is only schematically shown in FIG. 1, comprises a rotor 31, which is also present in the vacuum space 3 and is mounted to the external bearing member 21, and a stator 33, which is present outside the vacuum space 3 and is mounted to an external surface of the housing 1.

During operation, the source 5 generates an electron beam 35, which propagates via an electron beam path 37 extending perpendicularly to the main side 13 and which impinges upon the X-ray generating material 9 in an impingement position 39. X-rays 41 generated by the material 9 as a result of the incidence of the electron beam 35 emanate from the vacuum space 3 through a window 43, which is provided in the housing 1 and which is made from an X-ray transparent material, in this embodiment beryllium. Only a relatively small portion of the energy of the electron beam 35 is converted into X-ray energy. A relatively large portion of the energy of the electron beam 35 is absorbed by the carrier 7, as a result of which the carrier 7 is considerably heated during operation. Since, during operation, the carrier 7 is rotated about the axis of rotation 15, the impingement position 39 follows a circular path relative to the carrier 7 over the annular layer of the X-ray generating material 9. As a result, the carrier 7 is uniformly heated in the circumferential direction, so that excessive local temperatures of the carrier 7 are avoided. Since the carrier 7 is present in the vacuum space 3, transfer of heat from the carrier 7 to the surroundings of the device or to a cooling system of the device, necessary to avoid excessive temperatures of the carrier 7, mainly takes place by heat conduction via the dynamic groove bearing 17 and the liquid lubricant present therein and by heat radiation from the surfaces of the carrier 7.

A portion of the electrons of the electron beam 35 are scattered back from the impingement position 39, and accordingly a portion of the energy of the electron beam 35 is converted into energy of the scattered electrons. The scattered electrons are caught for the greater part by a heat absorbing member 45, which substantially has the same electrical potential as the carrier 7 and which is arranged in the vacuum space 3 between the source 5 and the carrier 7, i.e. between the source 5 and the impingement position 39. The heat absorbing member 45 is substantially rotationally symmetrical relative to the electron beam path 37, and has a central opening 47 for the electron beam 35 and an electron absorbing surface 49, which faces the carrier 7 and which will be further discussed in detail hereinafter. The heat absorbing member 45 is also used to absorb at least a portion of the radiant heat generated by the carrier 7 when heated during operation. As a result of the absorption of the scattered electrons and the radiant heat, the heat absorbing member 45 is heated during operation. As shown in FIG. 2, the heat absorbing member 45 is in thermal connection with a cooling system 51 of the device, which is only schematically shown in FIG. 2 and comprises an annular sleeve 53, which is made from a material having a relatively high thermal conductivity, in this embodiment copper, and an annular heat exchanger 55, which is provided with a system of cooling channels for a cooling liquid in direct thermal contact with the annular sleeve 53. The annular sleeve 53 and the heat exchanger 55 are arranged concentrically with respect to the electron beam path 37.

In view of the energy losses of the electron beam 35 as discussed before, a very high energy level of the electron beam 35 is necessary to generate X-rays 41 of a sufficiently high energy level. In the embodiment shown in FIGS. 1 and 2, the source 5 is suitable to generate an electron beam 35 of approximately 200 kW. Experiments have shown that approximately 40% of the energy of the electron beam 35 is absorbed by the heat absorbing member 45. If this amount of absorbed energy was instantaneously transferred from the heat absorbing member 45 to the cooling system 51, the necessary thermal capacity and dimensions of the cooling system 51 would be unacceptably high, or cooling system problems, such as boiling of the cooling liquid or melting of thin-walled structures of the cooling system 51, would occur. In order to avoid such substantial thermal capacities and dimensions of the cooling system 51 and to avoid such problems, the heat absorbing capacity of the heat absorbing member 45 and the heat transferring capacity of the thermal connection between the heat absorbing member 45 and the cooling system 51 are such that, during operation, a rate of heat absorption $Q_A$ (in kW) by the heat absorbing member 45 is substantially higher than a rate of heat transfer $Q_T$ (in kW) via the thermal connection. As a result, the heat absorbing member 45 is used to temporarily store the heat absorbed by the heat absorbing member 45, and the heat thus stored is gradually transferred from the heat absorbing member 45 to the cooling system 51 during the time that the device generates the X-rays 41 and afterwards when the device is not in operation. Thus, in order to prevent excessive temperatures of the heat absorbing member 45, the device has to be used discontinuously, i.e. after the generation of the X-rays 41 during a first period of time, the device should be out of operation for a second period of time, said first and said second period of time depending on the energy level of the electron beam 35. In the embodiment shown, for example, the device can be used in a number of different modes of operation. In a first mode of operation, the electron beam 35 has an energy level of 200 kW during a first period of time. After this, the device should be out of operation for a second period of time to allow the heated parts of the device to cool down again to a temperature close to the temperature of the cooling liquid. In a second mode of operation, the electron beam 35 has an energy level of 100 kW during a period of time which is approximately 3 times said first period of time, after which the device is out of operation to cool down again. In a third mode of operation the electron beam 35 has an energy level of 60 kW during a period of time which is approximately 7 times said first period of time, after which the device is out of operation to cool down again. In a fourth mode of operation, the device continuously generates X-rays 41 at a comparatively low energy level of the electron beam 35.

In the device according to the invention, the intended relation between $Q_A$ and $Q_T$ as described before is achieved in that the thermal connection between the heat absorbing member 45 and the cooling system 51 comprises a thermal barrier $\phi$ which limits the rate of cross-sectional heat transfer (in kW/K) occurring via the thermal connection per unit of temperature difference between the heat absorbing member 45 and the cooling system 51. It is noted that in the definition of $\phi$ said temperature difference is the difference between an average temperature $T_A$ of the heat absorbing member 45 and a temperature occurring at a thermal boundary between the thermal connection and the cooling system 51, i. e. at a location where the cooling liquid in the cooling system 51 is in direct thermal contact with the thermal connection. In the first embodiment shown in FIGS. 1 and 2, said thermal barrier comprises a mounting member 57 by means of which the heat absorbing member 45 is mounted in the vacuum space 3 between the source 5 and the carrier 7. The value of $\phi$ is effectively reduced in that a dimension $h_B$ of the mounting member 57, seen in a direction X parallel to the electron beam path 37, is substantially smaller than a dimension $h_A$ of the heat absorbing member 45 in said direction X, so that the mounting member 57 has a relatively small cross-sectional area available for the conduction of heat. A predetermined limitation of the value of $\phi$ can be achieved by a suitable value of said cross-sectional area, i. e. by suitable value of $h_B$. Since the value of $\phi$, i.e. the cross-sectional thermal conductivity of the thermal connection between the heat absorbing member 45 and the cooling system 51 is limited, a relatively high maximal temperature of the heat absorbing member 45 is allowed and achieved during the generation of the X-rays 41. As a result of said allowed relatively high maximal temperature, only a relatively small mass and volume of the heat absorbing member 45 are required to provide the heat absorbing member 45 with a sufficiently high heat absorbing capacity. In the first embodiment, the heat absorbing member 45 is made from molybdenum which has a relatively high melting temperature of approximately 2600° C. Alternatively, another material having a relatively high melting temperature may be used, such as tungsten or graphite. With such materials, relatively high temperatures of approximately 2000° C. of the heat absorbing member 45 are allowed, so that a considerable reduction of the necessary mass and volume of the heat absorbing member 45 is achieved.

In the first embodiment shown in FIGS. 1 and 2, the value of $\phi$ is further reduced in that the mounting member 57 is made from a material having a thermal conductivity which is smaller than a thermal conductivity of the material from which the heat absorbing member 45 is made. In this embodiment the mounting member 57 is made from stainless steel, which is a very suitable material in view of its heat conducting properties, its thermal expansion properties, and its mechanical properties. In the first embodiment, the value of $\phi$ is further reduced in that the mounting member 57 is in thermal contact with the heat absorbing member 45 near a second side 59 of the heat absorbing member 45 facing away from the carrier 7. Near this second side 59, during operation, the heat absorbing member 45 has a temperature which is lower than the average temperature $T_A$ of the heat absorbing member 45 and lower than a temperature of the heat absorbing member 45 near a first side 61 which faces the carrier 7, so that $Q_T$ is further limited. In the first embodiment, as a result, $Q_T$ has a maximal value of approximately 10 kW, which value occurs when the average temperate $T_A$ is approximately 2000° C. Thus, the value of $\phi$ is approximately 5 W/K. In order to relate the value of $\phi$ to the total power and capacity of the device, a cross-sectional heat transfer coefficient $\theta$ (in $K^{-1}$) of the thermal connection between the heat absorbing member 45 and the cooling system 51 is defined as $\theta=\phi/P_{max}$ wherein $P_{max}$ (in kW) is a maximal output power of the source 5 allowed for continuous operation of the device. In the first embodiment $P_{max}$ is approximately 25 kW, so that $\theta$ is approximately 0.0002 $K^{-1}$. It is noted however that also for larger values of $\theta$ a considerable reduction of the mass and volume of the heat absorbing member 45 is already achieved. It has been found that a useful and favorable reduction of the mass and volume of the heat absorbing member 45 within the meaning of the invention is achieved for values of $\theta$ smaller than approximately 0.0005 $K^{-1}$.

Since the maximal temperature of the heat absorbing member 45 is very close to the melting temperature of the material from which the heat absorbing member 45 is made, local excessive temperatures in the heat absorbing member 45 should be avoided. In the first embodiment shown in FIGS. 1 and 2, this is achieved as a result of the fact that the heat absorbing member 45 is substantially rotationally symmetrical relative to the electron beam path 37, and that the mounting member 57 is annular and concentric relative to the electron beam path 37. As a result, seen in a circumferential direction of the heat absorbing member 45, the heat absorbing member 45 is uniformly warmed up by the electrons scattered back from the impingement position 39, and the heat absorbed by the heat absorbing member 45 is uniformly transferred from the heat absorbing member 45 to the cooling system 51 via the mounting member 57.

The risk of local excessive temperatures, particularly near the electron absorbing surface 49, is limited in that the electron absorbing surface 49 has a concave shape as seen from the impingement position 39. It has been found that the electrons scattered back from the impingement position 39 have an energy level which depends on an angle $\alpha$, as shown in FIG. 2, at which the electrons are scattered back relative to the electron beam path 37. Said energy level is approximately proportional to $\sin(2\alpha)$, so that said energy level increases from approximately 0 at $\alpha=0°$ to a maximal value approximately at $\alpha=45°$. As a result of the fact that the electron absorbing surface 49 is concave, a portion $dS(\alpha)$ of the electron absorbing surface 49, shown in FIG. 2 and available to catch the electrons which are scattered back at a certain angle $\alpha$, also increases between $\alpha=0°$ and $\alpha=45°$. By optimizing the shape of the concave electron absorbing surface 49, it is achieved that the energy absorbed per unit of area of the electron absorbing surface 49 is approximately constant between $\alpha=0°$ and $\alpha=45°$, so that at least near this portion of the heat absorbing surface 49 the risk of local excessive temperatures is considerably reduced. For $\alpha>45°$, the energy level of the scattered electrons decreases again, but the available portion of the heat absorbing surface 49 increases further, so that local excessive temperatures are not likely to occur near this portion of the heat absorbing surface 49.

A further advantage of the device according to the first embodiment is that the mounting member 57, which is necessary to mount the heat absorbing member 45 in the vacuum space 3, also constitutes the necessary thermal barrier in the thermal connection between the heat absorbing member 45 and the cooling system 51. As a result, the device according to the first embodiment has a relatively simple construction in that the number of parts of the device is limited. It is noted, however, that the invention also covers alternative embodiments in which said thermal barrier constitutes an additional part of the device. The second embodiment of a device according to the invention, which is schematically shown in FIG. 3, also has a relatively simple construction in that the thermal barrier is a vacuum gap 63 which is present between the heat absorbing member 45 and the cooling system 51. In FIG. 3, parts of the device according to the second embodiment which correspond with parts of the device according to the first embodiment, as shown in FIGS. 1 and 2, are indicated by means of corresponding reference numbers. In the following, only the main differences between the devices according to the first and the second embodiment will be discussed.

The device according to the second embodiment mainly differs from the device according to the first embodiment in that the heat absorbing member 45 of the second embodiment is mounted in the vacuum space 3 by means of two mounting members 65, 67 which are made from a thermally insulating material. The heat absorbing member 45 comprises a circular cylindrical outer wall, which is concentric with respect to the electron beam path 37 and which constitutes a radiant heat transferring surface 69 of the heat absorbing member 45. The annular sleeve 53 comprises a circular cylindrical inner wall, which is also concentric with respect to the electron beam path 37 and which constitutes a radiant heat transferring surface 71 of the cooling system 51. The vacuum gap 63 is present between said radiant heat transferring surfaces 69 and 71 and is annular and also concentric relative to the electron beam path 37. In this second embodiment, transfer of heat from the heat absorbing member 45 to the cooling system 51 mainly takes place by radiation of heat from the radiant heat transferring surface 69 of the heat absorbing member 45 via the vacuum gap 63 to the radiant heat transferring surface 71 of the cooling system 51, as a result of which the values of $\phi$ and $\theta$ for the thermal connection between the heat absorbing member 45 and the cooling system 51 are effectively reduced. Intended values of $\phi$ and $\theta$ are achieved in this second embodiment by suitable values of the surface areas of the radiant heat transferring surfaces 69 and 71 and by a suitable value of the width w of the vacuum gap 63.

The invention claimed is:

1. A device for generating X-rays, which device comprises a source for emitting electrons, a carrier which is rotatable about an axis of rotation and which is provided with a material which generates X-rays as a result of the incidence of electrons, a heat absorbing member arranged between the source and the carrier, and a cooling system which is in thermal connection with the heat absorbing member, wherein during operation a rate of heat absorption by the heat absorbing member is substantially larger than a rate of heat transfer via the thermal connection, wherein the thermal connection between the heat absorbing member and the cooling system comprises a thermal barrier which limits the rate of heat transfer, occurring via the thermal connection per unit of temperature difference between the heat absorbing member and the cooling system, in a predetermined manner; wherein the thermal barrier comprises a vacuum gap which is present between a radiant heat transferring surface of the heat absorbing member and a radiant heat transferring surface of the cooling system.

2. A device as claimed in claim 1, wherein the thermal barrier comprises a mounting member by means of which the heat absorbing member is mounted in the device, said mounting member having a dimension, seen in a direction parallel to an electron beam path of the source, which is substantially smaller than a dimension of the heat absorbing member in said direction.

3. A device as claimed in claim 2, wherein the heat absorbing member is substantially rotationally symmetrical relative to the electron beam path, and the mounting member is annular and concentric relative to the electron beam path.

4. A device as claimed in claim 2, wherein the mounting member is made from a material having a thermal conductivity which is lower than a thermal conductivity of a material from which the heat absorbing member is made.

5. A device as claimed in claim 2, wherein the mounting member is made from stainless steel.

6. A device as claimed in claim 2, wherein the heat absorbing member has a first side facing the carrier and a second side facing away from the carrier, the mounting member being in thermal contact with the heat absorbing member near said second side.

7. A device as claimed in claim 1, wherein the heat absorbing member is made from a material selected from the group consisting of molybdenum, tungsten, and graphite.

8. A device as claimed in claim 1, wherein a side of the heat absorbing member facing the carrier has an electron absorbing surface which is concave as seen from an impingement position of the electrons on the carrier.

9. A device for generating X-rays comprising:

a source for emitting electrons, a carrier which is rotatable about an axis of rotation and which is provided with a material which generates X-rays as a result of the incidence of electrons, a heat absorbing member arranged between the source and the carrier such that substantially all of backscatter radiation strikes the surface of the heat absorbing member, and a thermal connection located between the heat absorbing member and a cooling system, comprising a separate and distinct component from said thermal connect and through which cooling fluid flow, the thermal connection located such that the thermal connection is not exposed to the backscatter radiation, the thermal connection comprising a thermal barrier comprised of a different material than that which comprises cooling system such that the thermal barrier limits the rate of heat transfer from the heat absorbing member to the cooling system in a predetermined manner.

10. The device as claimed in claim 9, wherein the heat absorbing member is made from a material selected from the group consisting of molybdenum, tungsten, and graphite.

11. A device for generating X-rays comprising:

a source for emitting electrons, a carrier which is rotatable about an axis of rotation and which is provided with a material which generates X-rays as a result of the incidence of electrons, a heat absorbing member arranged between the source and the carrier to absorb backscatter radiation, a cooling system comprising a housing and a cooling fluid passing therethrough; and a thermal connection located between, and distinct from, the heat absorbing member and the housing of the cooling system, the thermal connection comprising a thermal barrier that limits the rate of heat transfer from the heat absorbing member to the cooling system housing in a predetermined manner.

12. A device as claimed in claim 11, wherein the heat absorbing member is made from a material selected from the group consisting of molybdenum, tungsten, and graphite.

13. The device as claimed in claim 11, wherein the thermal connection is substantially free from exposure to backscatter radiation.

14. The device as claimed in claim 11, wherein the heat absorbing member includes a peripheral surface that contacts a surface of the thermal connection, wherein the peripheral surface of the heat absorbing member is substantially smaller than the contact surface of the thermal connection.

15. The device as claimed in claim 11, wherein the heat absorbing member includes a peripheral surface, wherein a first portion of the peripheral surface contacts the thermal connection and second portion of the peripheral surface does not contact any surfaces.

16. The device as claimed in claim 11, wherein the heat absorbing member includes a concave electron absorbing surface.

* * * * *